US006401991B1

(12) United States Patent
Eannone

(10) Patent No.: US 6,401,991 B1
(45) Date of Patent: Jun. 11, 2002

(54) COMPUTER TIMED-LOCKED MEDICATION CONTAINER WITH INDIVIDUAL COMPARTMENTS

(76) Inventor: Kathleen H. Eannone, 199 Pinebank Rd., Flemington, NJ (US) 08822

( * ) Notice: Subject to any disclaimer, the term of this patent is extended or adjusted under 35 U.S.C. 154(b) by 0 days.

(21) Appl. No.: 09/783,769

(22) Filed: Feb. 15, 2001

(51) Int. Cl.[7] ..... A47B 67/02

(52) U.S. Cl. ..... 222/638; 221/2; 221/3; 221/12; 221/15; 221/92; 221/103; 221/124; 221/154; 700/236; 700/244; 702/177; 340/309.1; 340/309.4; 368/10

(58) Field of Search ..... 222/638, 639, 222/644; 221/2, 3, 9, 12, 15, 16, 92, 103, 112, 114–118, 123–132, 154, 155; 700/236, 242–244; 702/177; 340/309.1, 309.4; 368/10

(56) References Cited

U.S. PATENT DOCUMENTS 3,762,601 A * 10/1973 McLaughlin ..... 221/2
3,917,045 A * 11/1975 Williams et al. ..... 221/15
4,275,384 A * 6/1981 Hicks et al. ..... 340/309.4
4,483,626 A * 11/1984 Noble ..... 368/10
4,962,491 A * 10/1990 Schaeffer ..... 221/15
5,142,484 A * 8/1992 Kaufman et al. ..... 222/638
5,710,551 A * 1/1998 Ridgeway ..... 221/15
5,826,217 A * 10/1998 Lerner ..... 702/177
5,954,225 A * 9/1999 Powe ..... 221/2
6,169,707 B1 * 1/2001 Newland ..... 368/10

OTHER PUBLICATIONS www.epill.com/epill/medtimeclosed.html.
www.epill.com/epill/medtimeopen.html.

* cited by examiner

*Primary Examiner*—J. Casimer Jacyna
(74) *Attorney, Agent, or Firm*—Kenneth P. Glynn, Esq.

(57) ABSTRACT

The present invention is a computer timed-locked medication container, which includes a container for holding medication. The container includes sidewalls, a partially open front, a back, a bottom, a top, at least one section extending from the partially open front to the back. Each section is sized and shaped to hold a plurality of compartments and each of the compartments is sized and shaped to hold at least one unit of medication. Each compartment has sidewalls, a bottom, a front, a back, opening-locking means for opening and locking at least one unit of medication in the compartment. When medication is due to be dispensed, an alarm will sound. Upon pressing a medication release button, the scheduled compartment will be opened and the medication will be accessible. If the medication button has not been sounded within a preselected time period, a message will be generated, either internally or through the Internet, on non-compliance. There is also a display means for displaying data that is either entered internally, retrieved from an internal medical database, or retrieved from the Internet. The device also includes a medical database and a program.

10 Claims, 5 Drawing Sheets

COMPUTER TIMED-LOCKED MEDICATION CONTAINER WITH INDIVIDUAL COMPARTMENTS

BACKGROUND OF THE INVENTION

Field of the Invention

The present invention relates to selective time-locked medication dispensing devices, which may be used by individual patients and/or by medical supervisory personnel. More particularly, it relates to those medication dispensing devices, which have a software program which controls time intervals for dispensing medication, opening and locking medication compartments, and retrieving and displaying medication related information. Moreover, there is automatic notification to individuals, both internally through the system and/or through the Internet, regarding patient compliance, and further having capability to record and play back voice mail. The device also relates to those devices having interface with other computerized medical technology through serial and USB ports.

Information Disclosure Statement

The current medication dispensing devices include those which are not time-locked, as well as those which are time-locked. Among those devices that are time-locked is the following:

A Med-time device from e-pill.com is a lockable unite that automatically beeps at designated times, and then rotates to open a compartment having the correct pills to take. To turn off the beeping all that is necessary is to pick up the dispenser and pur out the pills. The device automatically resets for the next medications. The medication is dispensed through an opening on a top of the device.

Notwithstanding the aforesaid prior art, the present invention system is neither taught nor rendered obvious thereby.

SUMMARY OF THE INVENTION

The present invention is a computer timed-locked medication container, which includes a container for holding medication. The container includes sidewalls, a partially open front, a back, a bottom, a top, at least one section extending from the partially open front to the back. Each section is sized and shaped to hold a plurality of compartments and each of the compartments is sized and shaped to hold at least one unit of medication. Each compartment has sidewalls, a bottom, a front, a back, opening-locking means for opening and locking at least one unit of medication in the compartment the compartment. There is a medication release button which opens the open-locking means in response to computer control and a pressing of the medication release button.

There is also a display means located on an outer surface of the container for displaying data that is either entered internally, retrieved from an internal medical database or an expert system, or retrieved from the Internet. In addition, there is an automatic message notifying means for automatically notifying individuals when the medication release button is not pressed after a preselected grace period following each of preselected times for dispensing the at least one unit of medication. The message notifying means may consist of writing a message on the display means or sending a message external to the device. Such external message may be an E-mail sent over the Internet either through serial connectors located on the device, through external modems, or wireless transmission.

The device also includes a medical database of drug related information in which the drug related information from the database is displayed on the display means and whereby search, retrieval and display of the medical database is controlled by a computer program. Such medical database may be expert systems such as *The Physician's Desk Reference*. The computer program includes the functions of controlling the opening means, retrieval and display of the drug-related information, automatic message notification on non-compliance, and entering drug information on drug name and frequency.

BRIEF DESCRIPTION OF THE DRAWINGS

The present invention should be more fully understood when the specification herein is taken in conjunction with the drawings appended hereto wherein:

FIG. 11 shows a perspective view of an alternative embodiment of a present invention computer timed-locked medication container while

FIG. 13 shows a top view of an alternative embodiment of a present invention computer timed-locked medication container while

DETAILED DESCRIPTION OF THE PRESENT INVENTION

Figure 1:
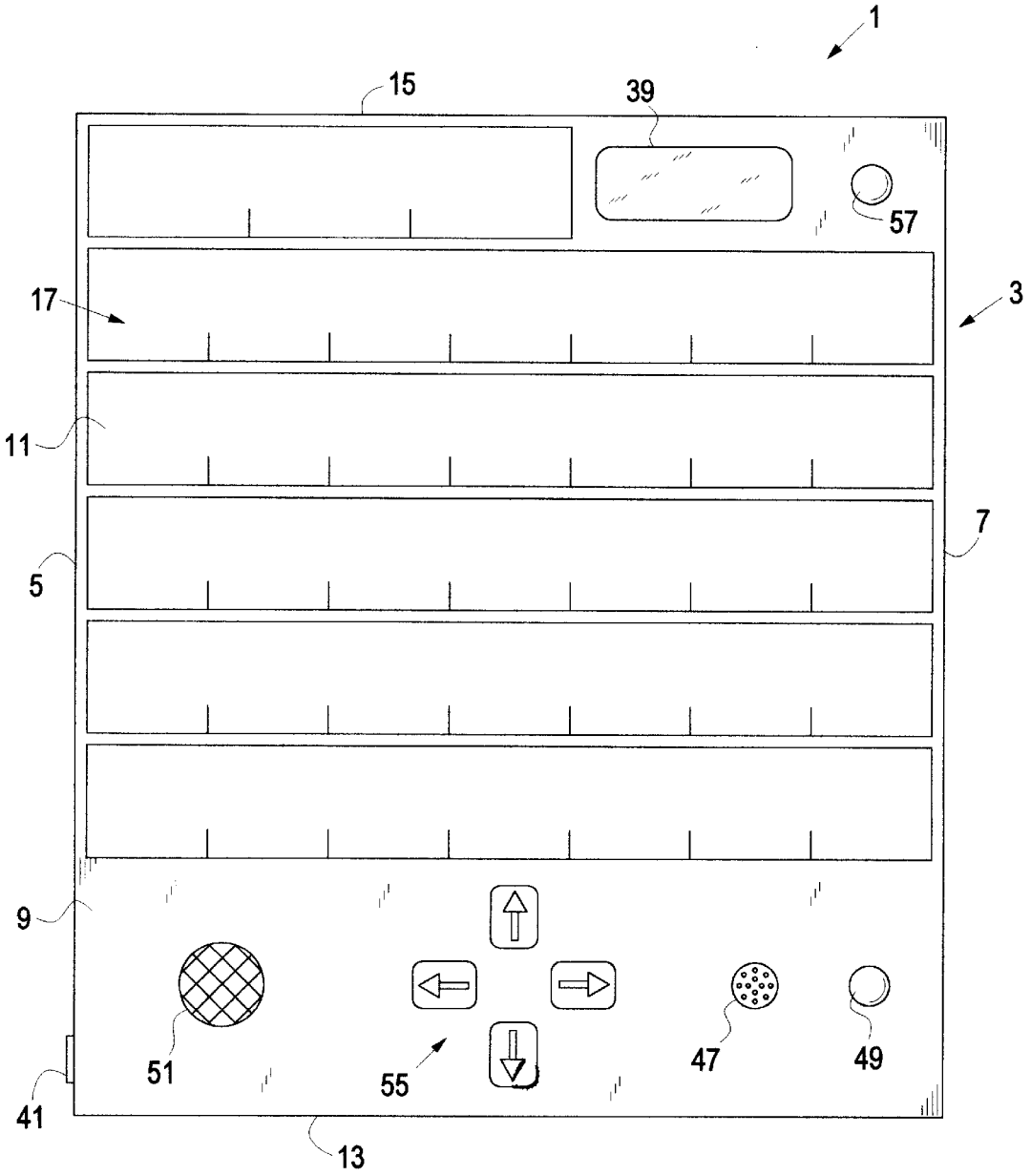
FIG. 1 shows a front view of a present invention computer timed-locked medication container with compartments removed.
Figure 2:
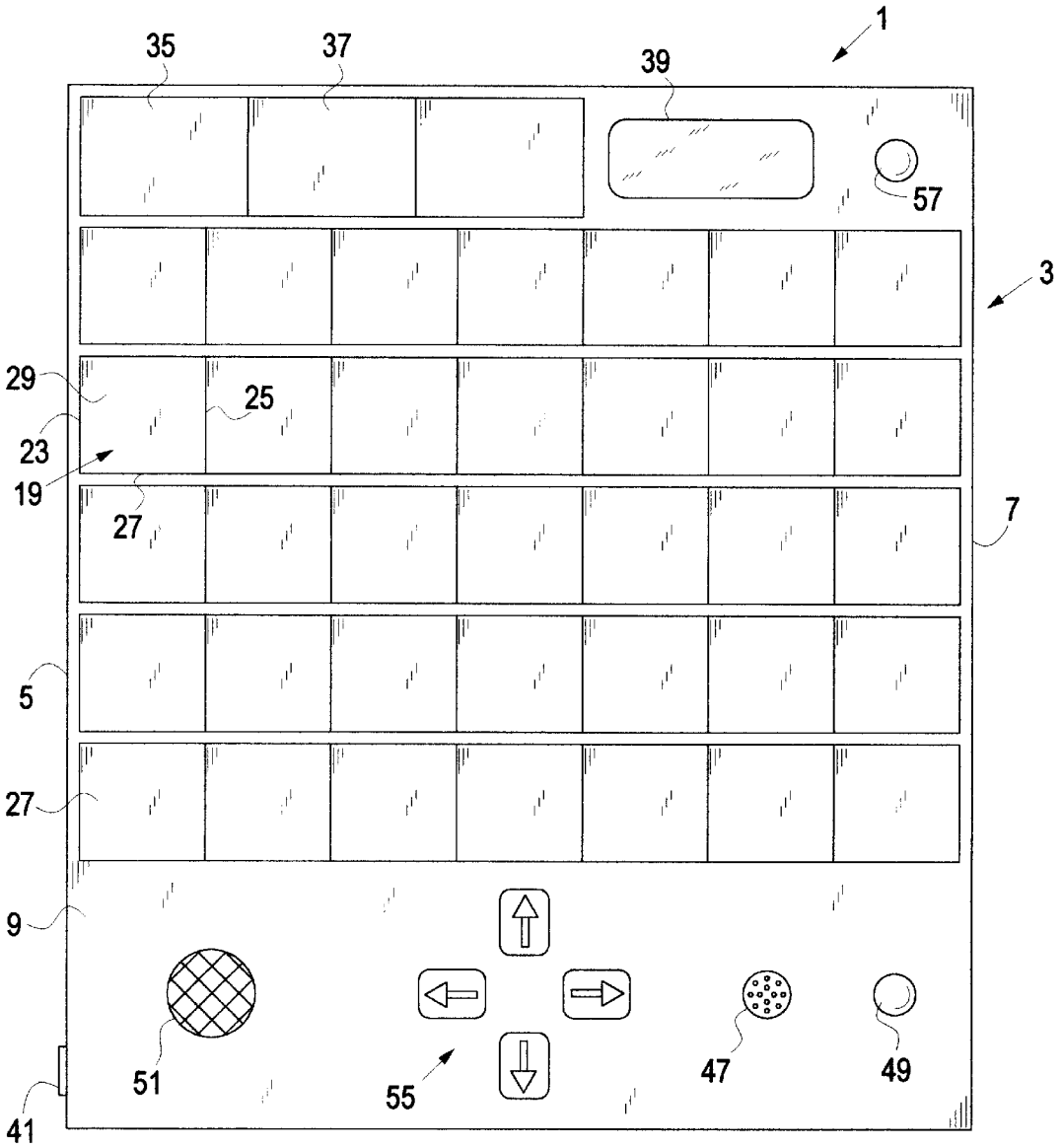
FIG. 2 shows a front view of the present invention computer timed-locked medication container shown in FIG. 1.

The present invention involves a selective time-locked medication dispensing device, which may be used by individual patients and/or by medical supervisory personnel. More particularly, it relates to those medication dispensing devices, which have a software program which controls time intervals for dispensing medication, controls opening and locking medication compartments at user specified intervals, and controls retrieving and displaying medication related information. Moreover, there is automatic notification to individuals, both internally through the system and/or through the Internet, regarding patient compliance, and further having capability to record and play back voice mail. The device also has interface capabilities with other computerized medical technology. It is particularly useful in telemedicine in that the device will alert an individual when medication is to be dispensed, and, at the same time, provide for locked security. It can also interface with other medical technology devices, such as a blood pressure check, a blood sugar level test, pulse reading, and the like, through serial and USB ports.

The device may monitor dispensing of multiple medications, wherein a different dispensing interval may be inputted by a user for each medication being monitored. There may be medication which is dispensed every time interval or there may be PRNs which are dispensed as needed within a pre-set time range, and can only be taken within the preset times. If an appropriate interval has not passed since the last dispensing, the compartment will not unlock.

Both the dispensing of medication and the dispensing of PRNs is monitored by a computer program. An individual inputs the necessary time information by flagging the information on a display screen by a programming means. When the time has been reached for dispensing a routine medication, an alarm will sound and a medication compartment will be programmed to be unlocked when the medication release button is pressed. If the individual desires a PRN, the compartment will only open if it is in a preselected time range from a previous dispensing.

In some embodiments, the compartment will only open on inputting a security code. The device may be locked by a key, or be part of a security system that is computer controlled.

The generation of compliance messages, as well as file searches are both internal to the system and external to the Internet. With the Internet communication, both wired through serial ports and wireless through satellite transmission are within the scope of the present invention.

Referring now to FIG. 1 through FIG. 4, there is shown a present invention computer timed-locked medication container 1. The device 1 includes a container 3 for holding a plurality of compartments 19, 21, 35, 37. The container 3 includes sidewalls 5, 7, a partially open front 9, a back 11, a bottom 13, a top 15, at least one section 17 extending from the partially open front 9 to the back 11. Each section 17 is sized and shaped to hold a plurality of compartments 19, 21, 35, 37 and each of the compartments 19, 21, 35, 37 is sized and shaped to hold at least one unit of medication. Each compartment 19, 21, 35, 37 has sidewalls 23, 25, a bottom 27, a front 29, a back 31, opening-locking means 33 for opening and locking at least one unit of medication in the compartment 19, 21, 35, 37. As shown, compartments 19, 21, 35, 37 form an array.

When a medication release button 57 is pressed, opening-locking means 33 will be unlocked if the computer program determines that it is time for medication to be dispensed. There is an alarm 51 located on partially open front 9 of the container 3, which is automatically sounded under computer program control ap preselected times for dispensing medication.

There is also a display means 39 located on an outer surface of the container 1 for displaying data that is either entered internally, retrieved from an internal medical database, or retrieved from the Internet. For example, an individual may leave messages relating to the patient condition or messages about when to give medication under certain conditions may be displayed. The system also may have access to the *Physician's Desk Reference*, the *Merck Manual*, and other such medical related references. The display means 39 may be an LCD screen, a computer monitor, or any such display device interfacing with a computer.

In addition, there is an automatic message notifying, means for automatically notifying individuals when the opening-locking means 33 remains open after a preselected grace period following each of preselected times for dispensing the at least one unit of medication. The message notifying means may consist of writing a message on the display means 39 or sending a message external to the device. Such external messages may be an E-mail sent over the Internet either through an at least one connector means 41 located on the device 1, or through wireless transmission, to the primary care physician, the home care nurse, or the primary care giver. Moreover, the at least one connector means 41 may be used for connection of the device 1 to at least one computer peripheral device or other medical equipment. The connector means 41 is located on an outer surface of the device 1. The connector means 41 may be a serial connector, a USB port, and the like.

The device 1 also includes a medical database of drug related information in which the drug related information from the database is displayed on the display means 39 and whereby search, retrieval and display of the medical database is controlled by a computer program 43 located in the rear of the device 1. The computer program 43 is located between the back 11 of the container 13 and a wall 45 behind the back 11 and extending along the length of the container 3. The computer program 43 includes the functions of controlling the opening-locking means, retrieval and display of the drug-related information, automatic message notification on non-compliance, and entering drug information on drug name and frequency.

Figure 3:
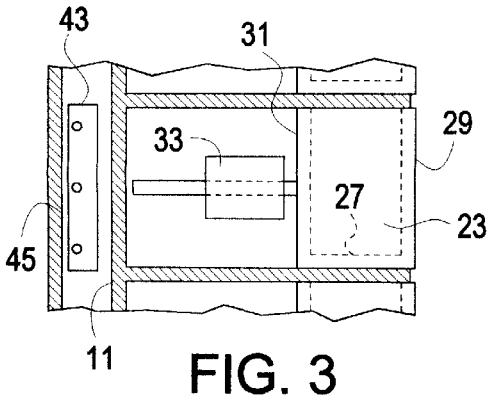
FIG. 3 shows a side view of the present invention computer timed-locked medication container shown in FIG. 1 having a solenoid lock in a locked position.
Figure 4:
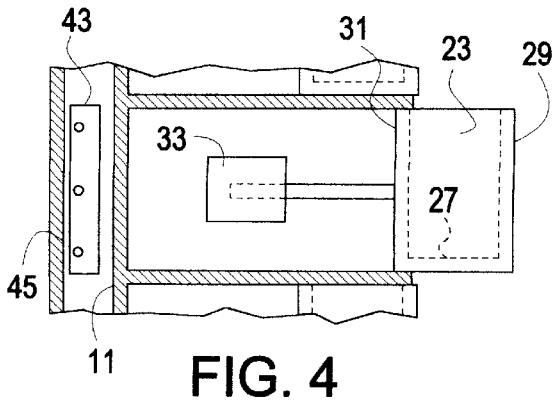
FIG. 4 shows a side view thereof having a solenoid lock in an open position.

Referring specifically to FIG. 3 and FIG. 4, there is shown a side view of the present invention computer timed-locked medication container 1 having opening-locking means, in this case a solenoid lock 33 in a locked position, and in an open position, respectively. Each compartment 19, 21, 35, 37 includes individual solenoid locks 33 attached to the back 31 of the compartment 19, 21, 35, 37, which have an individual drive which responds to a signal from the computer program 43.

The device 1 also includes an optional recording means 47 and playing-back means 49 for recording and playing back messages from individuals. The recording means 47 and playing-back means 49 is located on the partially open front 9 of the container 3. There is programming means 55 for entering information on the medication and frequency of medication, as well as entering override codes.

Of course, controlling the recording means and the playback means, sounding the alarm, and controlling communication with the at least one computer peripheral device are all accomplished through the computer program 43.

In operation, an individual uses locking override means, in this case, by entering an override code to open all compartments 19, 21, 35, 37 by the computer program 43 moving opening-locking means 33 to an open position. The individual then fills each compartment 19, 21, 35, 37 with medication and when completed enters a code to signal to the computer program that all compartments 19, 21, 35, 37 are filled and should be locked. The individual then enters frequency and drug related information, if it is to be revised. This is accomplished by moving the programming means, in this case arrows 55, so that information displayed on the display means 39 is selected. There can be multiple drugs which may be programmed. The computer program 43 keeps track of the time and automatically sounds the alarm 51 when the dose is to be taken. When the medication release button 57 is pressed, the compartment 19, 21, 35, 37, which has the unit of medication to be dispensed will open. When the medication is removed and the compartment 19, 21, 35, 37 is closed, the computer program 43 will not allow opening of the compartment 19, 21, 35, 37 until it is again scheduled through the preselected time intervals. If the medication release button 57 has not been pressed within a programmed specified grace period from when the medication is due, a report is generated on patient non-compliance either internally to the system or over the Internet through E-mail. When the medication has been removed from all the compartments 19, 21, 35, 37 and the compartments 19, 21, 35, 37 need to be refilled, the individual compartments 19, 21, 35 37 are opened through locking override means and refilled by an individual.

Individual compartments may be used to dispense PRNs. A user will specify time intervals for allowing dispensing the PRNs. Under computer control and the pressing of the medication release button 57, a PRN compartment will only open if the pre-specified time within a grace period of a specified time has elapsed from the previous PRN dispensing.

Figure 5:
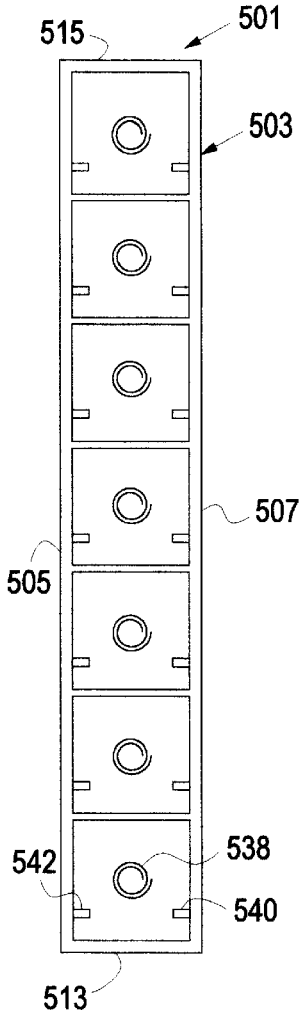
FIG. 5 shows a front view of an alternative embodiment present invention computer timed-locked medication container with compartments removed.
Figure 6:
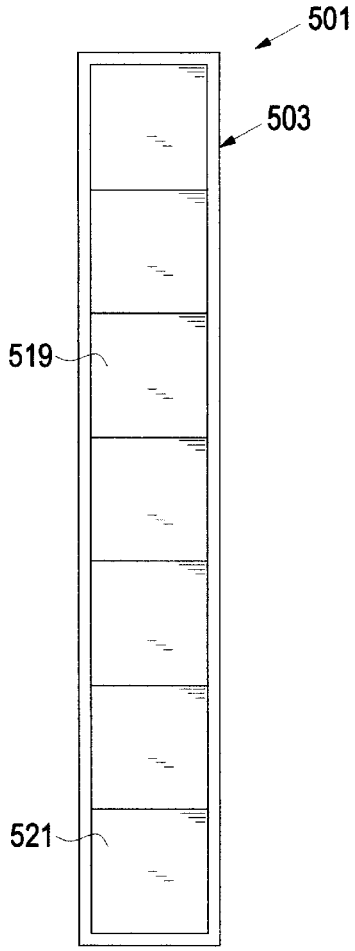
FIG. 6 shows a front view of the present invention computer timed-locked medication container shown in FIG. 5 with compartments present.
Figure 7:
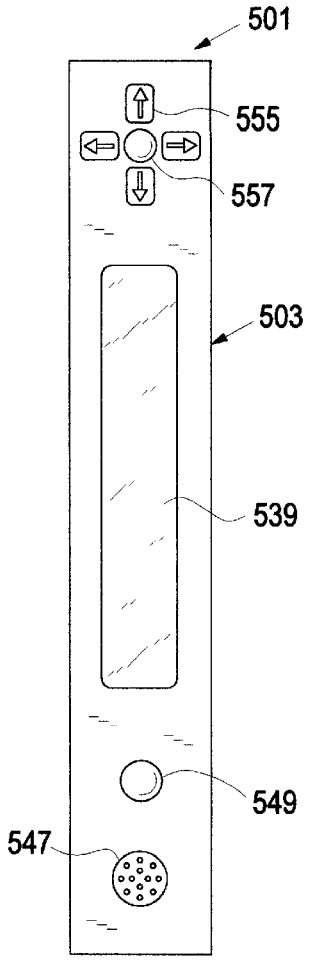
FIG. 7 shows a rear view of the present invention computer timed-locked medication container shown in FIG. 5.

Referring now to FIG. 5 through FIG. 7, there is shown a front view of an alternative embodiment present invention computer timed-locked medication container with compartments removed, a front view of the present invention computer timed-locked medication container shown in FIG. 5 with compartments present, and a rear view of the present invention computer timed-locked medication container shown in FIG. 5. Similar parts to those shown in FIG. 1 through FIG. 4 are similarly numbered but beginning with "500".

Figure 8:
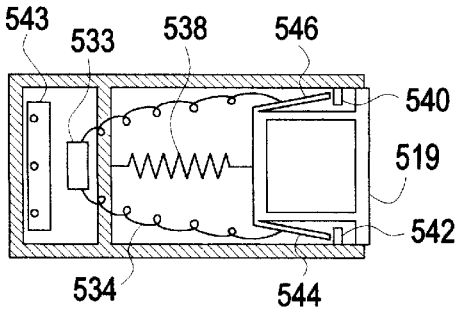
FIG. 8 shows a side view of the present invention computer timed-locked medication container shown in FIG. 5 having a wired chip for controlling opening means of a compartment.

As shown, the container 501 forms a column. Referring to FIG. 8, opening-locking means 533 is a chip having wired connection to at least one flexible side 544, 546 of the compartment 519. When the compartment 519 is locked a pin 540, 542 moves into a gap in the at least one flexible side 544, 546 of the compartment 519 and prevents opening of the compartment 519. Through computer control at preselected times and a pressing of a medication release button 557, the chip 533 sends a signal to move the at least one flexible side 544, 546 so that the compartment 519 springs out through movement away from the pin 540, 542 and pressure from a spring means 538. Once the medication has been removed, the compartment 519 is locked by an individual pushing the compartment inwardly into the container 501 so that the pins 540, 542 are moved into an opening on the at least one flexible side 544, 546. The functions of patient non-compliance notification, recording and play back means, and database retrieval are also inherent to this embodiment.

Figure 9:
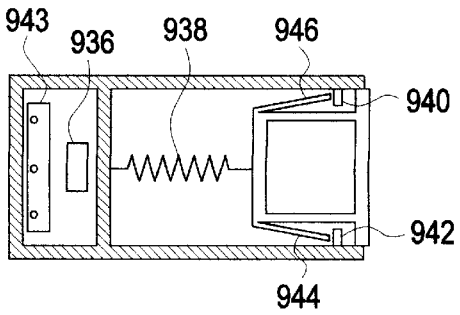
FIG. 9 shows a side view of an alternative embodiment of a present invention computer timed-locked medication container having a wireless chip for controlling opening means of a compartment and being in a closed position.
Figure 10:
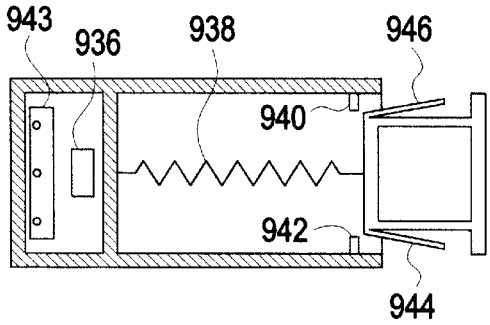
FIG. 10 shows the wireless chip for controlling opening means of a compartment thereof in an open position.

FIG. 9 and FIG. 10 show an alternative embodiment of an opening-locking means 936 in a locked position and an open position, respectively. Similar parts to those shown in FIG. 8 are similarly numbered but beginning with "900". The opening-locking means 936 is a chip that moves at least one flexible side 944, 946 to a locked position and a closed position, as described herein before under FIG. 5 through FIG. 8.

Figure 11:
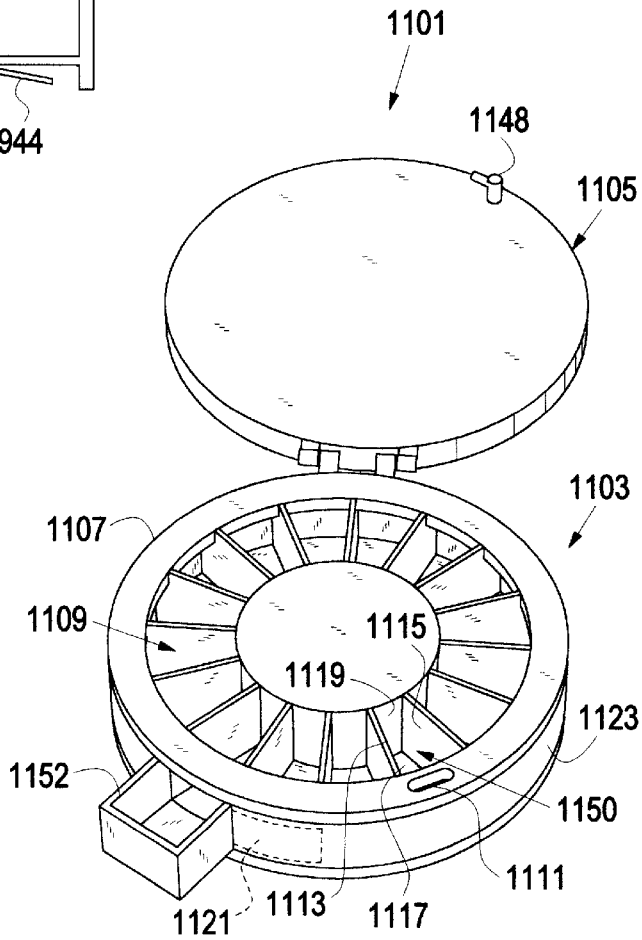
Figure 12:
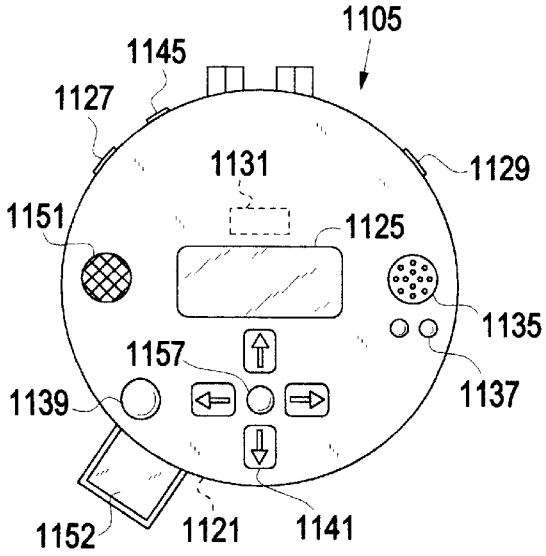
FIG. 12 shows a top view thereof.
Figure 13:
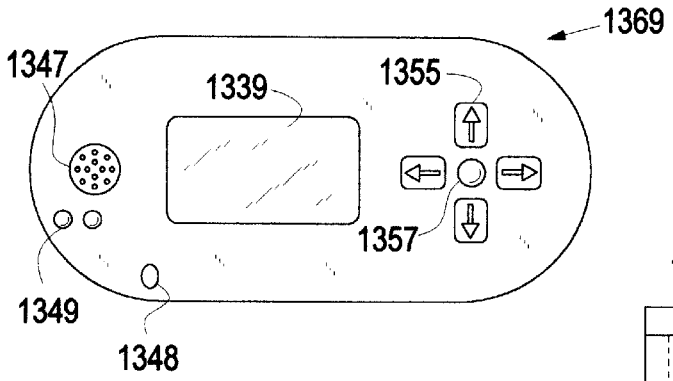
Figure 14:
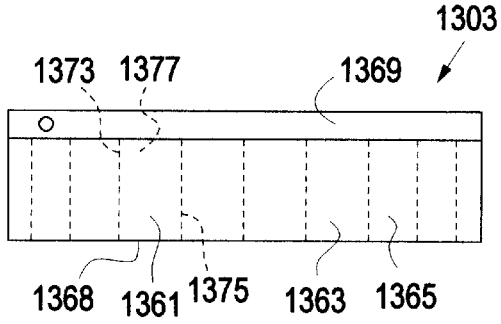
FIG. 14, FIG. 15 and FIG. 16 show front, side, and rear views respectively, thereof.
Figure 15:
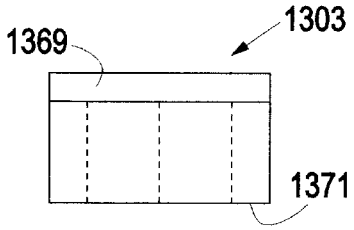
Figure 16:
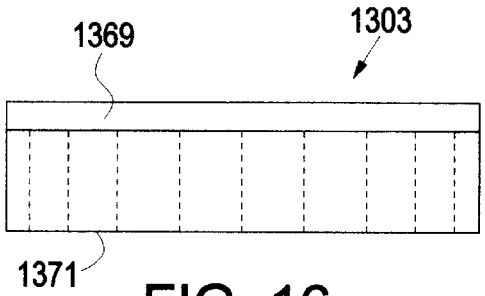

Referring now to FIGS. 11 and 12, there is shown an alternative embodiment of a present invention device 1101. The computer timed-locked medication container 1101, includes a container 1103 having a top portion 1105, a bottom portion 1107, a plurality of compartments 1109, 1111, opening-locking means 1121 for opening and for locking at least one unit of medication in each of the compartments 1109, 1111. The top portion 1105 and the bottom portion 1107 are locked together through lock 1148 and lock slot 1150 through a key. Once the device 1101 has been locked, access to the medication is prevented. Each compartment 1109, 1111 has sidewalls 1113, 1115, a bottom 1117, and a back 1119, and is sized and shaped to hold at least one unit of medication. There is an alarm 1151 which is automatically sounded through computer control at preselected time periods for dispensing medication.

The device 1101 also includes a mechanical controlling means, such as a card which mechanically controls movement of a continuous belt around the container 1101. In this case, the continuous belt is a rim 1123 having a opening-locking means, in this case receptacle 1121, which is attached to an outer side of the bottom portion 1107 of the container 1101. The receptacle 1121 includes a slidable cover 1151 which slides into an opposite side from where it is in a closed position on the receptacle 1121, in response to computer control and the pressing of medication release button 1157. The continuous belt 1123 moves in response to user specified, through computer control, preselected times so as to allow for dispensing of the at least one unit of medication when the receptacle 1121 is aligned with the desired compartment. After a pre-specified grace period after the medication release button 1157 has been pressed, the slidable cover 1151 is automatically moved to a closed position through computer control. After a preselected grace period from the time the medication is to dispensed, if the medication release button 1157 has not been pressed, a message on non-compliance will be generated either internal to the system or externally through the Internet.

There is also a display means 1125 located on the top portion 1105 of the container 1101 for displaying data that is either entered internally, retrieved from an internal medical database, or retrieved from the Internet. For example, an individual may leave messages relating to the patient condition or messages about when to give medication under certain conditions may be displayed. The system also may have access to the *Physician's Desk Reference*, the *Merck Manual*, and other such medical related references.

In addition, there is an automatic message notifying means for automatically notifying individuals when the medication release button 1157 has not been pressed within a preselected grace period following each of preselected times for dispensing the at least one unit of medication. The message notifying means may consist of writing a message on the display means 1125 or sending a message external to the device. Such external messages may be an E-mail sent over the Internet either through an at least one connector means 1127, 1129 located on the device 1101, or through wireless transmission. Moreover, the at least one connector means 1127, 1129 may be used for connection of the device 1101 to at least one computer peripheral device. The connector means 1127, 1129 is located on the top portion 1105 of the device 1101. The connector means 1127, 1129 may be a serial connector, a USB port, and the like.

The device 1101 also includes a medical database of drug related information in which the drug related information from the database is displayed on the display means 1125 and whereby search, retrieval and display of the medical database is controlled by a computer program 1131 located in the middle of the top portion 1105 of the device 1101. The computer program 1131 includes the functions of controlling the opening-locking means, retrieval and display of the drug-related information, automatic message notification on non-compliance, and entering drug information on drug name and frequency.

Furthermore, the device 1101 includes an optional recording means 1135 and playing-back means 1137 for recording and playing back messages from individuals. The recording means 1135 and playing-back means 1137 is located on the top portion 1105 of the device 1101. In addition, there is an medical alert alarm 1139 located on the top portion 1105 of the device 1101, which when pressed in medical emergencies will automatically send messages to appropriate agents or agencies for emergency medical help. There is programming means 1141 for entering information on the medication and frequency of medication, as well as entering override codes. AC adapter 1145 on the top portion 1105 of the device 1101 is used for charging a battery overnight.

Referring now to FIG. 13 through FIG. 18, there is shown an alternative embodiment of a present invention computer timed-locked medication container with individual compartments 1303. Similar parts to those shown in FIG. 1 are similarly numbered but beginning with "1300".

The computer timed-locked medication container with individual compartments 1303 includes a container 1303 having a top portion 1369, a bottom portion 1371, a plurality of compartments 1361, 1363, 1365, opening-locking means 1381 for opening and for locking at least one unit of medication in each of the compartments 1361, 1363, 1365. The top portion 1369 and the bottom portion 1371 are locked together through lock 1347 through a key. Once the device 1301 has been locked, access to the medication is prevented. Each compartment 1361 has sidewalls 1373, 1375, a bottom 1368, and a back 1377, and is sized and shaped to hold at least one unit of medication.

Figure 17:
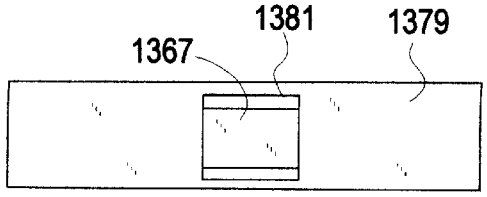
FIG. 17 shows a front view of a opening-locking means used in the present invention computer timed-locked medication container of FIGS. 13, 14, 15 and 16.

Referring specifically to FIG. 17, there is shown a front view of a continuous belt 1379 which rotates around the container 1303. The opening-locking means, in this case, the window 1381, is rotated through computer control to the compartment which is to have medication dispensed. A slidable cover 1367 on the window 1381 moves to open the window 1381 in response to pressing a medication release button 1357 when through computer control, medication is to be dispensed. If the medication release button 1357 has not been pressed within a pre-specified time period after a medication is due, a message on non-compliance will be generated either internally to the system or externally through Internet transmission.

Figure 18:
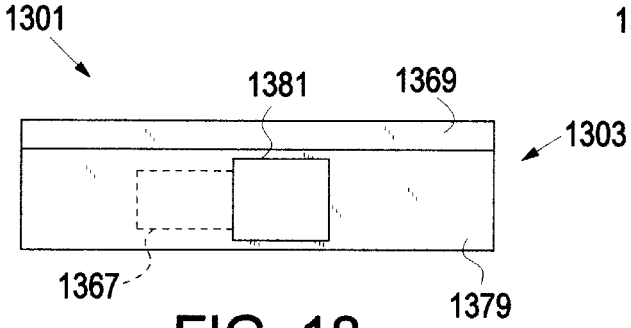
FIG. 18 shows a front view of a computer timed-locked medication container with individual compartments with the container of FIGS. 13, 14, 15 and 16 and the opening-locking means of FIG. 17.

FIG. 18 shows a front view of a computer timed-locked medication container with individual compartments 1301 with the container 1303 of FIGS. 13, 14, 15 and 16 and the opening-locking means 1381 of FIG. 17.

Obviously, numerous modifications and variations of the present invention are possible in light of the above teachings. For example, voice activation of the dispensing times and security overrides, are envisioned within the scope of the present invention. It is, therefore, understood that within the scope of the appended claims, the invention may be practiced otherwise than as specifically described herein.

What is claimed is:

1. A computer timed-locked medication container, which comprises:

(a) a container for holding medication including sidewalls, a partially open front, a back, a bottom, a top, at least one section extending from said partially open front to said back, each section sized and shaped to hold a plurality of compartments, each of said compartments sized and shaped to hold at least one unit of medication, said compartment having sidewalls, a bottom, a front, a back, opening-locking means for opening and locking at least one unit of medication in said compartment;

(b) a display means located on an outer surface of said container for displaying data selected from one of the group consisting of entered internally, retrieved from an internal medical database, and retrieved from the Internet;

(c) an alarm located on one of said top, partially open front, and said sidewalls of container wherein said alarm is automatically sounded at intervals within a grace period of preselected times for dispensing said at least one unit of medication;

(d) a medication release button located on an outer surface of said device for automatically opening said opening-locking means at said preselected times when medication is to be dispensed, through computer control and pressing of said medication release button;

(e) an automatic message notifying means for automatically notifying individuals when said medication release button remains unmoved after a preselected grace period following each of computer controlled said preselected times for dispensing the at least one unit of medication wherein said message notifying means is selected from one of the group consisting of writing a message on said display means and sending a message external to said device;

(f) a medical database of drug related information wherein said drug related information from said database is displayed on said display means and wherein search, retrieval and display of said medical database is controlled by a computer program; and (g) said computer program including the functions of controlling said opening-locking means, retrieval and display of said drug-related information, automatic message notification on non-compliance, entering drug information on drug name and frequency, and interface with other medical equipment.

2. The computer timed-locked medication container of claim 1 wherein said device further comprises:

(a) recording means and playing-back means for recording and playing back messages from individuals wherein said recording means and playing-back means is located on one of said top, said partially open front, and said sidewalls of said container; and (b) at least one connector means for connection of said device to at least one computer peripheral device wherein said at least one connector means is located on an outer surface of said device, wherein said computer program further includes the functions of controlling said recording means and said play-back means, sounding said alarm, controlling communication with the at least one computer peripheral device, downloading data, and sending E-mail.

3. The computer timed-locked medication container of claim 2 wherein said opening-locking means is selected from one of the group consisting of a solenoid lock attached to said back of each said compartment, a chip with a wireless connection to each said compartment, and a chip hard-wired to each said compartment.

4. The computer timed-locked medication container of claim 1 wherein said opening-locking means is selected from one of the group consisting of a solenoid lock attached to said back of each said compartment, a chip with a wireless connection to each said compartment, and a chip hard-wired to each said compartment.

5. The computer timed-locked medication container of claim 4 wherein said computer program automatically generates E-mail when said preselected grace period for dispensing said at least one unit of medication has expired and said medication release button has not been pressed.

6. The computer timed-locked medication container of claim 5 wherein said plurality of compartments form a shape wherein said shape is selected from one of the group consisting of a two-dimensional array and a rod.

7. The computer timed-locked medication container of claim 6 wherein different said compartments include different medication types.

8. The computer timed-locked medication container of claim 7 wherein different medication types may be scheduled for a same preselected time for dispensing.

9. The computer timed-locked medication container of claim 8 wherein said at least one connector means is selected from one of the group consisting of serial connector and universal serial bus port.

10. The computer timed-locked medication container of claim 9 wherein said device further includes a locking override means for overriding said opening-locking means whereby said compartments may be refilled.

* * * * *